US007202767B2

(12) United States Patent
Maekawa et al.

(10) Patent No.: US 7,202,767 B2
(45) Date of Patent: Apr. 10, 2007

(54) IGNITION APPARATUS FOR AN INTERNAL COMBUSTION ENGINE

(75) Inventors: Toshio Maekawa, Tokyo (JP); Takeshi Shimizu, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 62 days.

(21) Appl. No.: 11/202,244

(22) Filed: Aug. 12, 2005

(65) Prior Publication Data

US 2006/0226945 A1 Oct. 12, 2006

(30) Foreign Application Priority Data

Apr. 12, 2005 (JP) ..... 2005-114545

(51) Int. Cl.
*H01F 21/00* (2006.01)
*H01F 27/36* (2006.01)

(52) U.S. Cl. ..... 336/110; 336/90; 336/92; 336/84 M

(58) Field of Classification Search ..... 336/90, 336/92, 96, 198, 208, 84, 110; 123/634–635
See application file for complete search history.

(56) References Cited

U.S. PATENT DOCUMENTS 4,658,799 A * 4/1987 Kusaka et al. ..... 123/622
4,990,881 A * 2/1991 Ooyabu ..... 336/110
5,349,320 A * 9/1994 Suzuki et al. ..... 336/92
5,685,065 A * 11/1997 Suzuki et al. ..... 29/606
5,734,311 A * 3/1998 Murata ..... 336/96
5,764,124 A * 6/1998 Nakamichi et al. ..... 336/92
6,211,763 B1 * 4/2001 Morita ..... 336/110
7,132,916 B2 * 11/2006 Maekawa et al. ..... 336/90

FOREIGN PATENT DOCUMENTS

JP 07-263256 A 10/1995

* cited by examiner

*Primary Examiner*—Anh Mai
(74) *Attorney, Agent, or Firm*—Sughrue Mion, PLLC

(57) ABSTRACT

An ignition apparatus for an internal combustion engine includes a central core, a primary coil and a secondary coil arranged outside of the central core, a magnet arranged in abutment with one end face of the central core and magnetized in a direction opposite to the direction of a magnetic flux generated by energization of the primary coil, a side core arranged outside of the first and second primary coils so as to cooperate with the central core and the magnet to form a closed magnetic circuit, and a flexible core cover arranged to cover the side core. The side core includes a first side core section and a second side core section which have their one end faces arranged in abutment with each other. The first and second side core sections have their other ends in abutment against the magnet and the other end face of the central core, respectively.

10 Claims, 4 Drawing Sheets

IGNITION APPARATUS FOR AN INTERNAL COMBUSTION ENGINE

BACKGROUND OF THE INVENTION

1. Field of the Invention

The present invention relates to an ignition apparatus for an internal combustion engine which supplies a high voltage to a spark plug for each engine cylinder.

2. Description of the Related Art

As a conventional ignition apparatus for an internal combustion engine, there has been known one which includes a central core, a primary coil and a secondary coil both arranged outside of the central core, a magnet that is arranged in abutment with one end face of the central core and adapted to be magnetized in a direction opposite to the direction of a magnetic flux generated by energization of the primary coil, a side core that is arranged outside of the first and second coils and serves to cooperate with the central core and the magnet to form a closed magnetic circuit, a core cover attached to the side core, a case which receives therein the above-mentioned respective members, and a insulating resin filled into the case so as to fix the respective members to one another (see, for example, a first patent document: Japanese patent application laid-open No. H7-263256 (FIG. 1)).

In such a conventional ignition apparatus for an internal combustion engine, the magnet arranged to abut against the one end face of the central core is disposed at a location between a pair of parallel legs of the substantially U-shape side core. The magnet magnetically attracts the central core and the side core, so that a gap is generated between an end portion of the side core and the other end face of the central core at which the magnet is not arranged. In this case, there arises a problem that if this gap is large, most of the magnetic flux generated by energization of the primary coil leaks through the gap, resulting in reduction in magnetic efficiency.

Thus, there is a need to decrease the gap between the other end face of the central core and the end portion of the side core as much as possible, but it is necessary to press-fit the central core and the magnet into the side core depending upon dimensional variations of the central core, the side core and the magnet, as a result of which there arises another problem of poor assembling workability.

SUMMARY OF THE INVENTION

Accordingly, the present invention is intended to obviate the above-mentioned problems, and has for its object to obtain an ignition apparatus for an internal combustion engine which is capable of improving assembling workability without reducing magnetic efficiency.

Bearing the above object in mind, according to the present invention, there is provided an ignition apparatus for an internal combustion engine which includes: a central core having one end face and an other end face; a primary coil and a secondary coil arranged outside of the central core; a magnet arranged in abutment with the one end face of the central core, the magnet being magnetized in a direction opposite to the direction of a magnetic flux generated by energization of the primary coil; a side core arranged outside of the first primary coil and the secondary coil so as to cooperate with the central core and the magnet to form a closed magnetic circuit; and a core cover with flexibility arranged to cover the side core. The side core includes a first side core section having one end face and an other end face, and a second side core section having one end face and an other end face, the first and second side core sections being arranged with their one end faces being in abutment with each other. The other end of the first side core section is arranged in abutment against the magnet, and the other end of the second side core section is also arranged in abutment against the other end face of the central core.

According to the ignition apparatus for an internal combustion engine of the present invention, assembling workability can be improved without reducing magnetic efficiency.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Figure 1:
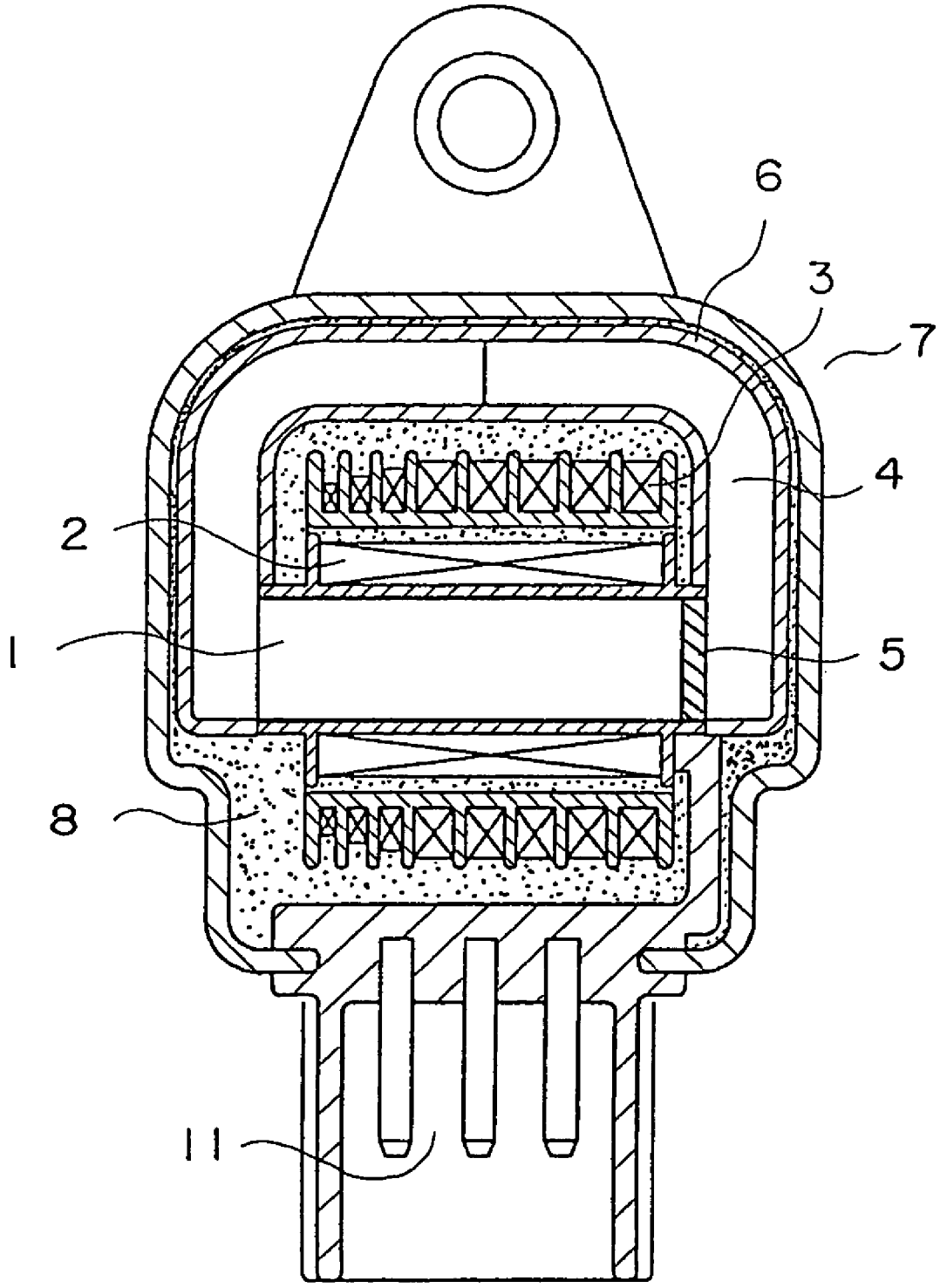
FIG. 1 is a cross sectional view showing an ignition apparatus for an internal combustion engine according to a first embodiment of the present invention.

Now, preferred embodiments of the present invention will be described in detail while referring to the accompanying drawings. Throughout respective figures, the same or corresponding members or parts are identified by the same reference numerals and characters.

Embodiment 1.

Figure 2:
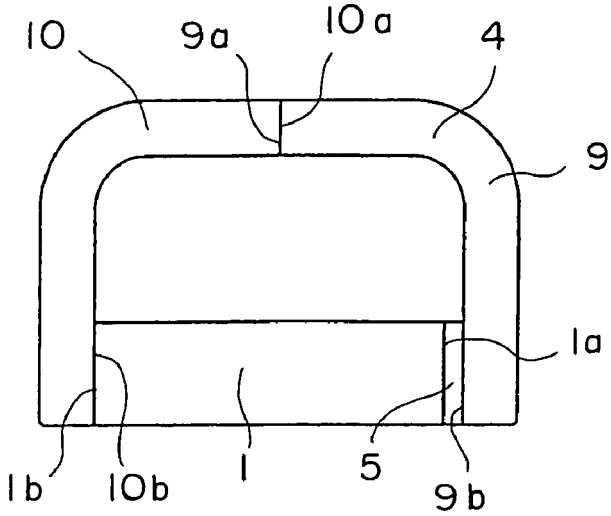
FIG. 2 is a front elevational view showing a central core, a side core, and a magnet in FIG. 1.

FIG. 1 is a cross sectional view that shows an ignition apparatus for an internal combustion engine according to a first embodiment of the present invention. FIG. 2 is a front elevational view that shows a central core 1, a side core 4 and a magnet 5 in FIG. 1.

In this ignition apparatus for an internal combustion engine, a primary coil 2 is arranged outside of the central core 1 of a substantially I-shaped configuration formed of a plurality of pieces of electrical steel plates laminated or stacked one over another. A secondary coil 3 is arranged outside of the primary coil 2.

The magnet 5, being magnetized in a direction opposite to the direction of a magnetic flux generated by energization of the primary coil 2, is arranged so as to abut against one end face of the central core 1 which is formed of the laminated pieces of the electrical steel plates, as stated above. Outside of the secondary coil 3 there is arranged the U-shaped side core 4, which cooperates with the central core 1 and the magnet 5 to form a closed magnetic circuit. The side core 4 is covered with a flexible core cover 6 which is made of thermoplastic elastomer except for the inner side of the opposite ends thereof.

The central core 1, the primary coil 2, the secondary coil 3, the side core 4, the magnet 5 and the core cover 6 are received in a container 7 while being fixedly secured to one another by means of an insulating resin 8 in the form of an epoxy resin of a thermosetting property.

The side core 4 comprises a first side core section 9 and a second side core section 10 which have their one end faces 9*a* and 10*a* arranged in abutment with each other. The first side core section 9 has its other end 9*b* in abutment with the magnet 5, and the second side core section 10 has its other end 10*b* in abutment with the other end face 1*b* of the central core 1.

The side core 4 is divided into the two pieces, i.e., the first side core section 9 and the second side core section 10, but the divided side core sections 9, 10 are received in the flexible core cover 6 and are integrated with each other to form a substantially U shape.

Figure 3:
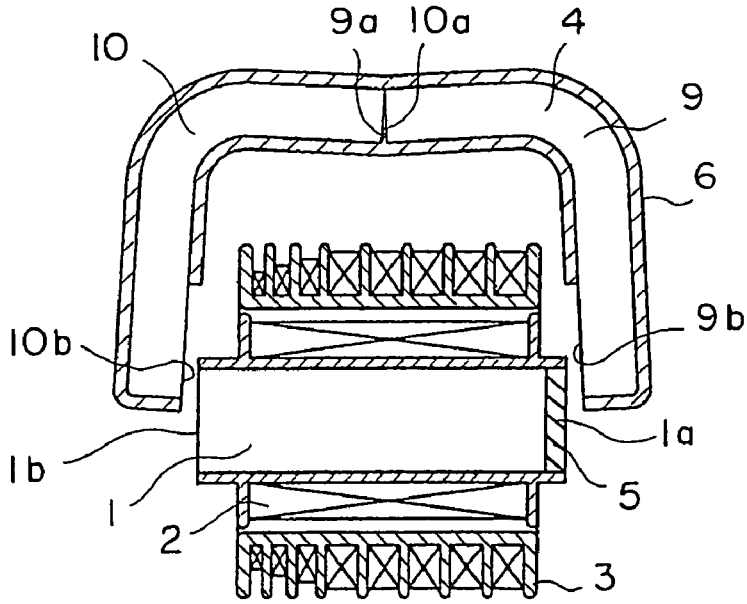
FIG. 3 is a view showing that the ignition apparatus for an internal combustion engine of FIG. 1 is in the process of production.

In the ignition apparatus for an internal combustion engine as constructed above, as shown in FIG. 3, the magnet 5 is in abutment with the one end face 1*a* of the central core 1, and the side core 4 integrally combined with the core cover 6 by means of insert molding is assembled to the central core 1 with the primary coil 2 and the secondary coil 3 being assembled to the outer periphery of the central core 1.

The side core 4 is of a substantially U shaped configuration, and is received in the flexible core cover 6 while being divided into the first side core section 9 and the second side core section 10, so the first side core section 9 and the second side core section 10 can rotate in directions away from each other and can be restored toward each other.

Accordingly, the inner dimension on an opening side of the side core 4 is set substantially equal to the longitudinal dimension of the central core 1 with the magnet 5 assembled thereto, but in the process of assembling, the first side core section 9 and the second side core section 10 are rotated in directions away from each other, and thereafter, the other end 9*b* of the first side core section 9 comes to abut against the magnet 5, and the other end 10*b* of the second side core section 10 also comes to abut against the other end face 1*b* of the central core 1.

After this, a half-finished or semiprocessed product, which is produced by assembling the central core 1, the magnet 5, the primary coil 2, and the secondary coil 3 and the side core 4 integrally molded with the core cover 6 with one another, is received in a container 7, and an insulating resin 8 is finally filled into the container 7.

Now, the operation of the ignition apparatus for an internal combustion engine as constructed above will be explained below.

The energization and deenergization or interruption of a primary current flowing through the primary coil 2 by way of the connector assembly 11 is controlled by a control signal from a control unit (not shown) of the internal combustion engine. When the primary current flowing through the primary coil 2 is interrupted by the control signal at a prescribed ignition timing of the internal combustion engine, a counter electromotive force is generated in the primary coil 2, whereby a high voltage is produced in the secondary coil 3.

The high voltage thus produced is impressed to a spark plug (not shown) of the internal combustion engine connected to the secondary coil 3 through a high-tension cord (not shown) or the like.

Here, note that the magnet 5 is arranged in a direction to repulse the magnetic flux generated by energization of the primary coil 2, so that an increased amount of magnetic energy is accumulated in the central core 1 and the side core 4.

As described in the foregoing, according to the ignition apparatus for an internal combustion engine of this first embodiment, the side core 4 is composed of the first side core section 9 and the second side core section 10 with their one end faces 9*a*, 10*a* being in abutment with each other, and the side core 4 is covered with the flexible core cover 6. With such an arrangement, the first side core section 9 and the second side core section 10 can rotate in a direction away from each other, and restore or move toward each other. As a result, by utilizing the rotating and restoring action of the first side core section 9 and the second side core section 10, the other end 9*b* of the first side core section 9 can be forced into abutment against the magnet 5, and the other end 10*b* of the second side core section 10 can be forced into abutment against the other end face 1*b* of the central core 1. Accordingly, assemblability or assembling workability can be improved without reducing magnetic efficiency due to the generation of a gap.

In addition, the other end 9*b* of the first side core section 9 and the other end 10*b* of the second side core section 10 extend in parallel with each other, and the direction of excitation in the central core 1 is vertical with respect to the one end face 1*a* of the central core 1 and the other end face 1*b* of the central core 1. With such an arrangement, reduction in size of the ignition apparatus for an internal combustion engine can be made, whereby the ignition apparatus for an internal combustion engine can be installed in an engine room of a limited space in a easy manner.

Moreover, since the core cover 6 is made of thermoplastic elastomer, it has flexibility and can be easily formed by means of injection molding.

Further, since the abutment portions of the first side core section 9 and the second side core section 10 are arranged in the core cover 6, the first side core section 9 and the second side core section 10 can be integrated with the core cover 6 in a reliable manner.

Here, note that the core cover 6 is a member arranged to absorb a thermal stress generated by a difference in the coefficient of linear expansion between the side core 4 and insulating resin 8, but it does not newly add a special member. Also, the configuration or shape of the central core 1 can be changed into a substantially L shape or substantially T shape so as to ensure a contact area with the magnet 5.

Embodiment 2.

Figure 4:
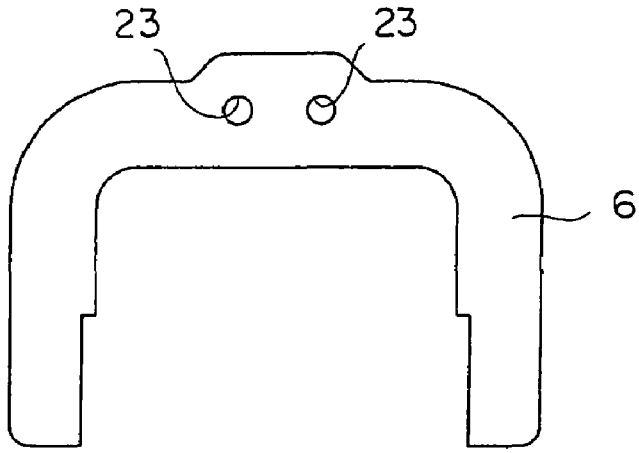
FIG. 4 is a front elevational view showing a side core covered with a core cover in an ignition apparatus for an internal combustion engine according to a second embodiment of the present invention.
Figure 5:
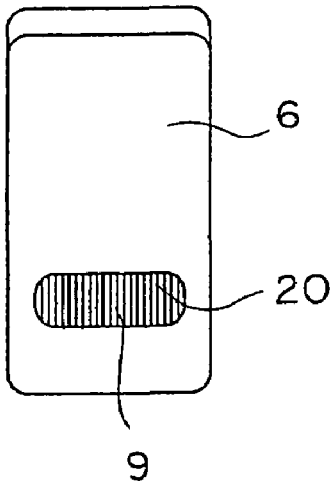
FIG. 5 is a right side view of FIG. 4.
Figure 6:
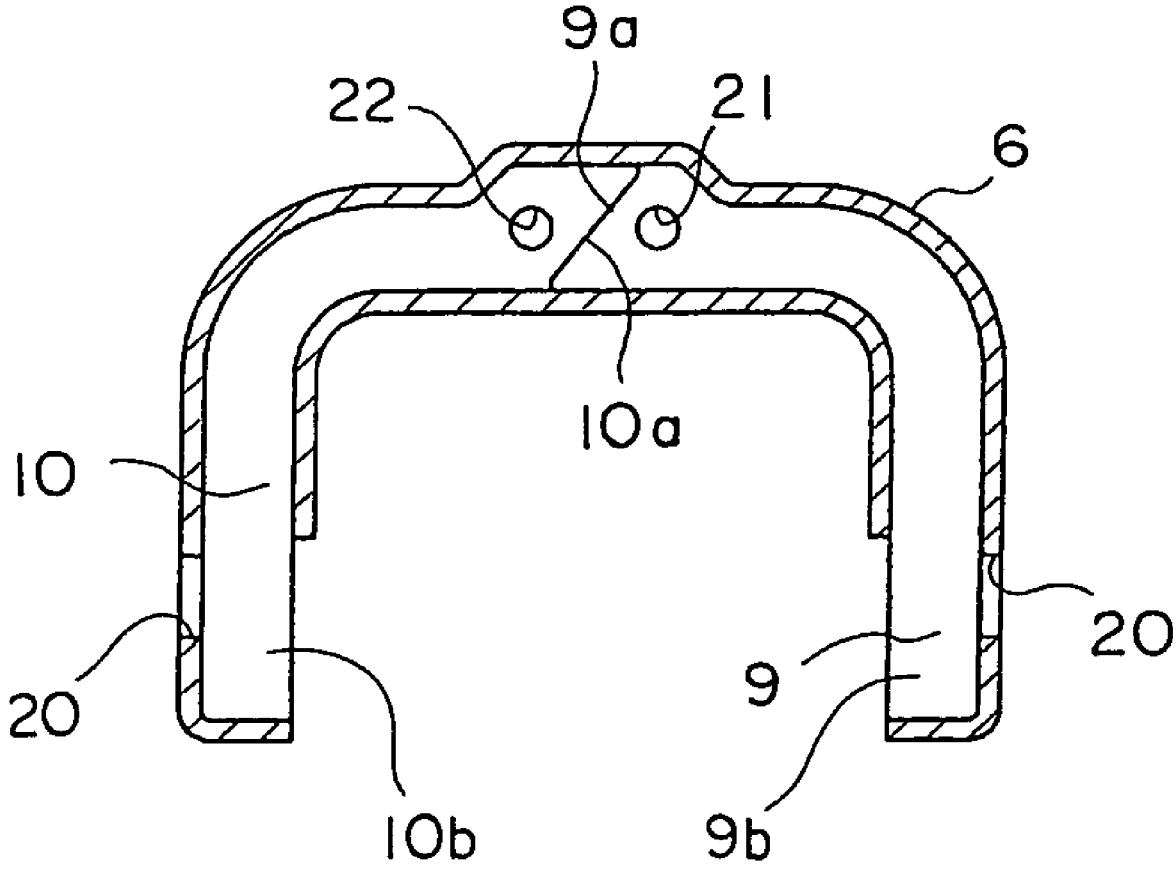
FIG. 6 is a cross sectional view of FIG. 4.

FIG. 4 is a front elevational view that shows a core cover 6 in an ignition apparatus for an internal combustion engine according to a second embodiment of the present invention. FIG. 5 is a right side view of the core cover 6 in FIG. 4. FIG. 6 is a cross sectional view of FIG. 4.

In this second embodiment, a first side core through hole 21 and a second side core through hole 22 are formed in the vicinity of the abutment portions of the first side core section 9 and the second side core section 10, respectively, in which the one end face 9*a* of the first side core section 9 and the one end face 10*a* of the second side core section 10 are in abutment with each other. Those portions of the first side core section 9 and the second side core section 10 which are around the first side core through hole 21 and the second side core through hole 22, respectively, diverge or enlarge outward by an amount of the diametral length of the first side core through hole 21 and by an amount of the diametral length of the second side core through hole 22, respectively. The one end faces 9*a*, 10*a* of the first side core section 9 and the second side core section 10 are sloped surfaces which are in abutment with each other at an inclination with respect to a closed magnetic circuit.

In this second embodiment, the first side core section 9 and the second side core section 10 are integrated with the core cover 6 by means of insert molding. At the time of insert molding, inside a mold, the respective other ends 9*b*, 10*b* of the first side core section 9 and the second side core section 10 are urged or pressed in inward directions by a pair of first support members. Here, note that a reference numeral 20 denotes a pair of first through holes formed in the opposite end portions of the core cover 6 at locations corresponding to the first support members.

In addition, upon insert molding, inside the mold, a pair of second support members are arranged to extend through the first side core through hole 21 and the second side core through hole 22, respectively, thereby to position the first side core section 9 and the second side core section 10 in an appropriate manner. Here, note that a reference numeral 23 denotes a pair of second through holes formed in an intermediate portion of the core cover 6 at locations corresponding to the second support members.

Thus, the first side core section 9 and the second side core section 10 do not move or displace under the action of injection molding pressure inside the mold, so the core cover 6 can have a uniform wall thickness, and no gap is generated between the one end face 9*a* of the first side core section 9 and the one end face 10*a* of the second side core section 10.

Moreover, those portions of the first side core section 9 and the second side core section 10 which are around the first side core through hole 21 and the second side core through hole 22, respectively, diverge or enlarge outward by the amount of the diametral length of the first side core through hole 21 and by the amount of the diametral length of the second side core through hole 22, respectively, whereby it is possible to reduce or suppress a magnetic loss due to a decrease in the magnetic circuit area resulting from forming the through holes 21, 22.

Further, the one end faces 9*a*, 10*a* of the first side core section 9 and the second side core section 10 are sloped surfaces, respectively, so even if a minute gap is generated between the one end faces 9*a*, 10*a* of the side core sections 9, 10, for example, due to production variations of the first side core section 9 and the second side core section 10, the abutment area of the one end faces 9*a*, 10*a* will increase. Thus, a leakage flux can be suppressed to a low level, and hence a magnetic loss can also be suppressed to a low level.

Although in the above-mentioned respective embodiments, the first side core section 9 and the second side core section 10 are formed into substantially the same shape, the first side core section and the second side core section can take different shapes from each other as long as the combined shape of the first side core section and the second side core section is substantially a U-shaped configuration.

In addition, although the thermoplastic elastomer is used as a material for the core cover 6, a flexible material such as silicone rubber may be used for this purpose.

Moreover, although the first side core section 9, the second side core section 10 and the core cover 6 are integrally combined with one another by means of insert molding, the core cover may instead be fitted onto the outer peripheries of the first side core section 9 and the second side core section 10. In this case, there is no need to arrange the core cover along the entire outer peripheries of the first side core section 9 and the second side core section 10, and there will be no problem even if the core cover may take any shape as long as it can integrally combine the first side core section 9 and the second side core section 10 with each other.

Furthermore, the present invention can be applied even to such an ignition apparatus for an internal combustion engine in which the primary coil is arranged outside of the secondary coil.

While the invention has been described in terms of preferred embodiments, those skilled in the art will recognize that the invention can be practiced with modifications within the spirit and scope of the appended claims.

What is claimed is:

1. An ignition apparatus for an internal combustion engine comprising:

a central core having one end face and an other end face;

a primary coil and a secondary coil arranged outside of said central core;

a magnet arranged in abutment with the one end face of said central core, said magnet being magnetized in a direction opposite to the direction of a magnetic flux generated by energization of said primary coil;

a side core arranged outside of said primary coil and said secondary coil so as to cooperate with said central core and said magnet to form a closed magnetic circuit; and a core cover with flexibility arranged to cover said side core;

wherein said side core comprises a first side core section having one end face and an other end face, and a second side core section having one end face and an other end face, said first and second side core sections being arranged with their one end faces being in abutment with each other; and the other end of said first side core section is arranged in abutment against said magnet, and the other end of said second side core section is also arranged in abutment against the other end face of said central core.

2. The ignition apparatus for an internal combustion engine as set forth in claim 1, wherein the other end of said first side core section and the other end of said second side core section extend in parallel with each other.

3. The ignition apparatus for an internal combustion engine as set forth in claim 2, wherein the direction of said magnetic flux of said central core is vertical with respect to said one end face and said other end face of said central core.

4. The ignition apparatus for an internal combustion engine as set forth in claim 1, wherein said central core takes a substantially I shape, a substantially L shape or a substantially T shape, and said side core comprising said first side core section and said second side core section integrally combined with each other by said core cover takes a substantially U shape.

5. The ignition apparatus for an internal combustion engine as set forth in claim 1, wherein said core cover is made of thermoplastic elastomer.

6. The ignition apparatus for an internal combustion engine as set forth in claim 1, wherein said first side core section and said second side core section have their abutment portions arranged in said core cover.

7. The ignition apparatus for an internal combustion engine as set forth in claim 6, wherein said first side core section and said second side core section have a first side core through hole and a second side core through hole, respectively, formed therethrough in the vicinity of said abutment portions; and said core cover is integrally combined with said side core by insert molding with said side core being positioned by a pair of second support members extending through said first side core through hole and said second side core through hole, respectively, in a mold, and said core cover has a pair of second through holes formed therethrough at locations corresponding to said second support member.

8. The ignition apparatus for an internal combustion engine as set forth in claim 7, wherein said first side core section has a portion around said first side core through hole outwardly enlarged by an amount of the diametral length of said first side core through hole; and said second side core section has a portion around said second side core through hole outwardly enlarged by an amount of the diametral length of said second side core through hole.

9. The ignition apparatus for an internal combustion engine as set forth in claim 1, wherein said core cover is integrally combined with said side core by insert molding with said side core being positioned by a pair of first support members in a mold, and said core cover has a pair of first through holes formed therethrough at locations corresponding to said first support members.

10. The ignition apparatus for an internal combustion engine as set forth in claim 1, wherein said one end faces of said first side core section and said second side core section are sloped surfaces, respectively.

* * * * *